US010283058B2

(12) United States Patent
Han et al.

(10) Patent No.: US 10,283,058 B2
(45) Date of Patent: May 7, 2019

(54) DISPLAY DEVICE AND DRIVING METHOD THEREOF

(71) Applicant: SAMSUNG DISPLAY CO., LTD., Yongin-si, Gyeonggi-Do (KR)

(72) Inventors: Songyi Han, Asan-si (KR); Gwangteak Lee, Cheonan-si (KR); Won-Hyoung Kang, Asan-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 91 days.

(21) Appl. No.: 15/455,749

(22) Filed: Mar. 10, 2017

(65) Prior Publication Data

US 2017/0263193 A1 Sep. 14, 2017

(30) Foreign Application Priority Data

Mar. 14, 2016 (KR) ..... 10-2016-0030443

(51) Int. Cl.
*G09G 3/34* (2006.01)
*G09G 3/36* (2006.01)

(52) U.S. Cl.
CPC ..... *G09G 3/3406* (2013.01); *G09G 3/3648* (2013.01); *G09G 2310/0237* (2013.01); *G09G 2320/0646* (2013.01)

(58) Field of Classification Search
CPC ... G09G 2310/0237; G09G 2320/0646; G09G 3/3406; G09G 3/3648
USPC ..... 345/690
See application file for complete search history.

(56) References Cited

U.S. PATENT DOCUMENTS 7,839,126 B2 * 11/2010 Lee ..... H02M 3/156 323/222
2002/0185994 A1 * 12/2002 Kanouda ..... H02M 3/158 323/282
2005/0285579 A1 * 12/2005 Yasukouchi ..... H02M 3/1588 323/282
2006/0071651 A1 * 4/2006 Ito ..... H02M 3/1588 323/351

(Continued)

FOREIGN PATENT DOCUMENTS

KR 1020130060876 6/2013
KR 10-1627292 5/2016

*Primary Examiner* — Tony O Davis
(74) *Attorney, Agent, or Firm* — F. Chau & Associates, LLC

(57) ABSTRACT

Provided is a display device including a plurality of light sources configured to be driven by a driving voltage, turned on during an on section, and turned off during an off section, a display panel configured to display an image by using light outputted from the light sources, a voltage converter connected to the light sources and configured to generate the driving voltage, and a backlight control circuit including a light source driving circuit and a voltage drop circuit. The light source driving circuit includes a pulse generator including a control input terminal configured to receive a first voltage during the on section and receive a second voltage during the off section and output a control pulse signal to control a level of the driving voltage based on a voltage applied to the control input terminal. The voltage drop circuit applies the second voltage to the control input terminal during the off section. The second voltage is smaller than the first voltage.

23 Claims, 4 Drawing Sheets

(56) References Cited

U.S. PATENT DOCUMENTS

2006/0164377 A1* 7/2006 Struebel ..... H05B 33/0815 345/102
2006/0208717 A1* 9/2006 Shimizu ..... H02M 3/157 323/284
2008/0252271 A1* 10/2008 Iwamura ..... H02M 3/1588 323/271
2009/0146631 A1* 6/2009 Fukumori ..... H02M 3/1588 323/284
2009/0160422 A1* 6/2009 Isobe ..... H02M 3/156 323/349
2010/0019692 A1* 1/2010 Kimura ..... H05B 33/0815 315/294
2010/0033110 A1* 2/2010 Chien ..... H05B 33/0815 315/294
2010/0264847 A1* 10/2010 Chen ..... H05B 33/0815 315/295
2010/0283411 A1* 11/2010 Chen ..... H05B 33/0812 315/307
2011/0227496 A1* 9/2011 Lin ..... H05B 33/0818 315/209 R
2012/0112645 A1* 5/2012 Lee ..... H05B 33/0818 315/186
2012/0153848 A1* 6/2012 Shin ..... G09G 3/3406 315/192
2012/0306388 A1* 12/2012 Jang ..... G09G 3/3406 315/186
2013/0119881 A1* 5/2013 Fang ..... H05B 33/0815 315/210
2014/0176618 A1* 6/2014 Lee ..... H05B 33/0818 345/690
2014/0211192 A1* 7/2014 Grootjans ..... H05B 33/0818 356/5.01
2015/0130371 A1* 5/2015 Lee ..... H05B 33/0851 315/307
2015/0312982 A1* 10/2015 Melanson ..... H05B 33/0815 315/287
2016/0066388 A1* 3/2016 Seki ..... H05B 33/0815 315/200 R
2016/0126848 A1* 5/2016 Sasaki ..... H05B 33/0815 349/69
2016/0128148 A1* 5/2016 Sasaki ..... H05B 33/0815 349/69
2016/0225307 A1* 8/2016 Yoon ..... G09G 3/2092
2016/0359410 A1* 12/2016 Kumasaka ..... H02M 3/157
2017/0027034 A1* 1/2017 Nozawa ..... H05B 33/0842
2017/0236472 A1* 8/2017 Yonemaru ..... G09G 3/342 345/690

* cited by examiner

DISPLAY DEVICE AND DRIVING METHOD THEREOF

CROSS-REFERENCE TO RELATED APPLICATIONS

This U.S. non-provisional patent application claims priority under 35 U.S.C. § 119 to Korean Patent Application No. 10-2016-0030443, filed on Mar. 14, 2016, the disclosure of which is incorporated by reference herein.

BACKGROUND

1. Technical Field

The present disclosure herein relates to a display device and a driving method thereof, and more particularly, to a display device with improved electromagnetic noise and a driving method thereof.

2. Discussion of Related Art

A liquid crystal display device includes a liquid crystal layer disposed between a color filter substrate and a thin film transistor substrate. When a voltage is applied to an electrode disposed on each of the color filter substrate and the thin film transistor, a vertical electric field formed by an applied voltage difference controls the directions of liquid crystal molecules within the liquid crystal layer. According to the directions of liquid crystal molecules, the transmittance of light is controlled so that an image is displayed. Since a liquid crystal display device is not a self-light emitting display device, a backlight unit is required. The back light unit includes a light source, which may include a plurality of light emitting diodes LEDs.

SUMMARY

Embodiments of the present disclosure provide a display device and a driving method thereof, and more particularly, a display device with improved electromagnetic noise and a driving method thereof.

An exemplary embodiment of the inventive concept provides a display device including: a plurality of light sources configured to be driven by a driving voltage, turned on during an on section, and turned off during an off section; a display panel configured to display an image by using light outputted from the light sources; a voltage converter connected to the light sources and configured to generate the driving voltage; and a backlight control circuit including a light source driving circuit and a voltage drop circuit, wherein the light source driving circuit includes a pulse generator including a control input terminal configured to receive a first voltage during the on section and receive a second voltage during the off section and output a control pulse signal for controlling a level of the driving voltage based on a voltage applied to the control input terminal. The voltage drop circuit applies the second voltage to the control input terminal during the off section. The second voltage is smaller than the first voltage.

In an embodiment, the first voltage is determined based on a voltage at one end of each of the light sources.

In an embodiment, the light source driving circuit outputs the control pulse signal to the voltage converter and determines a width of the control pulse signal based on a voltage applied to the control input terminal, and the voltage converter generates the driving voltage based on the width of the control pulse signal.

In an embodiment, the pulse generator further includes a reference input terminal and an output terminal; the pulse generator outputs a high signal to the output terminal when a voltage inputted to the control input terminal is greater than a first reference voltage applied to the reference input terminal, and the pulse generator outputs a low signal to the output terminal when a voltage inputted to the control input terminal is smaller than the first reference voltage.

In an embodiment, the backlight control circuit further includes a response control circuit configured to control a level of the first voltage over time in the on section, the level of the first voltage increases over time in an increase section of the on section, and the level of the first voltage is maintained at a constant level over time in a maintenance section of the on section.

In an embodiment, the response control circuit is connected to the control input terminal and the response control circuit includes a control resistor and a control capacitor.

In an embodiment, a pulse width of the control pulse signal increases over time in the increase section.

In an embodiment, the display device further includes a dimming circuit configured to output a dimming signal for controlling a brightness of the light sources, an input terminal of the voltage drop circuit is connected to the dimming circuit to receive the dimming signal, an output terminal of the voltage drop circuit applies the second voltage to the pulse generator in synchronization with the dimming signal, and the dimming signal may have a turn on level in the on section and have a turn off level in the off section.

In an embodiment, the voltage drop circuit includes an auxiliary reception terminal, a first distribution resistor, and a second distribution resistor, and the voltage drop circuit receives a second reference voltage from the auxiliary reception terminal to generate the second voltage by using a ratio of a resistance of the first distribution resistor to a resistance of the second distribution resistor.

In an embodiment, the voltage drop circuit further includes a buffer circuit configured to output the second voltage; and one end of the first distribution resistor is connected to the auxiliary reception terminal and the other end of the first distribution resistor is connected to one end of the second distribution resistor and an input terminal of the buffer circuit, and the other end of the second distribution resistor is connected to a ground electrode and an output terminal of the buffer circuit is connected to the control input terminal.

In an embodiment, the voltage drop circuit further includes an inverter; one end of the inverter is connected to the dimming circuit and the other end of the inverter circuit is connected to a power terminal of the buffer circuit; and the buffer circuit is turned off by the turn on level and turned on by the turn off level.

In an embodiment, the voltage drop circuit further includes a third resistor and a switching element; and one end of the third resistor is connected to an output terminal of the buffer circuit and the other end of the third resistor is connected to an input electrode of the switching element, and an output electrode of the switching element is connected to the ground electrode and a gate electrode of the switching element is connected to the other end of the inverter.

In an exemplary embodiment of the inventive concept, a display device driving method includes: a dimming circuit outputting a dimming signal having a turn on level indicating that a plurality of light sources is to be turned on during an on section and having a turn off level indicating that the light sources are to be turned off during an off section; a compensation circuit applying a first voltage to a control input terminal of a pulse generator during the on section in response to the dimming signal having the turn on level; a voltage drop circuit applying a second voltage to the control input terminal during the off section in response to the dimming signal having the turn off level; the pulse generator outputting a control pulse signal based on the first and second voltages; and a voltage converter controlling a level of a driving voltage applied to the light sources based on the control pulse signal, wherein the second voltage is smaller than the first voltage.

In an embodiment, the first voltage is determined based on a voltage at one end of each of the light sources.

In an embodiment, the controlling of the duty ratio may include comparing the first voltage and a first reference voltage during the on section to output the control pulse signal.

In an embodiment, the control pulse signal has have a high level during the on section when the first voltage is greater than the first reference voltage and the control pulse signal has a low level during the on section when the first voltage is smaller than the first reference voltage.

In an embodiment, a level of the first voltage increases over time during an increase section of the on section and is maintained at constant level during a maintenance section of the on section, and the maintenance section is located between the increase section and the off section.

In an embodiment, the voltage drop circuit generates the second voltage by: receiving a second reference voltage from an auxiliary reception terminal during the off section; and distributing the second reference voltage by a ratio of a resistance of a first distribution resistor to a resistance of a second distribution resistor.

In an embodiment, the generating of the second voltage further includes applying a voltage distributed by the ratio to a buffer input terminal of a buffer circuit, wherein one end of the first distribution resistor is connected to the auxiliary reception terminal and the other end of the first distribution resistor may be connected to one end of the second resistor and the buffer input terminal; and the other end of the second resistor is connected to a ground electrode and a buffer output terminal of the buffer circuit is connected to the control input terminal.

An exemplary embodiment of the inventive concept provides a backlight circuit including a plurality of light source strings, a dimming circuit configured to output a dimming signal having a turn on level indicating that a plurality of light sources is to be turned on during an on section and having a turn off level indicating that the light sources are to be turned off during an off section, a pulse generator, a compensation circuit configured to apply a first voltage to a control input terminal of the pulse generator during the on section in response to the dimming signal having the turn on level, a voltage drop circuit configured to apply a second voltage to the control input terminal during the off section in response to the dimming signal having the turn off level, a voltage converter configured to control a level of a driving voltage applied to each of the light strings based on as control pulse signal output by the pulse generator, where the second voltage is smaller than the first voltage.

In embodiment, the pulse generator outputs the control pulse signal by comparing the first voltage and a first reference voltage during the on section.

In an embodiment, the control pulse signal has a high level during the on section when the first voltage is greater than the first reference voltage and the control pulse signal has a low voltage when the first voltage is smaller than the first reference voltage.

In an embodiment, a level of the first voltage increases over time during an increase section of the on section and is maintained at constant level during a maintenance section of the on section, and the maintenance section is located between the increase section and the off section.

BRIEF DESCRIPTION OF THE FIGURES

The present invention will become more apparent by describing in detail exemplary embodiments thereof with reference to the accompanying drawings in which.

DETAILED DESCRIPTION OF THE EXEMPLARY EMBODIMENTS

Figure 1:
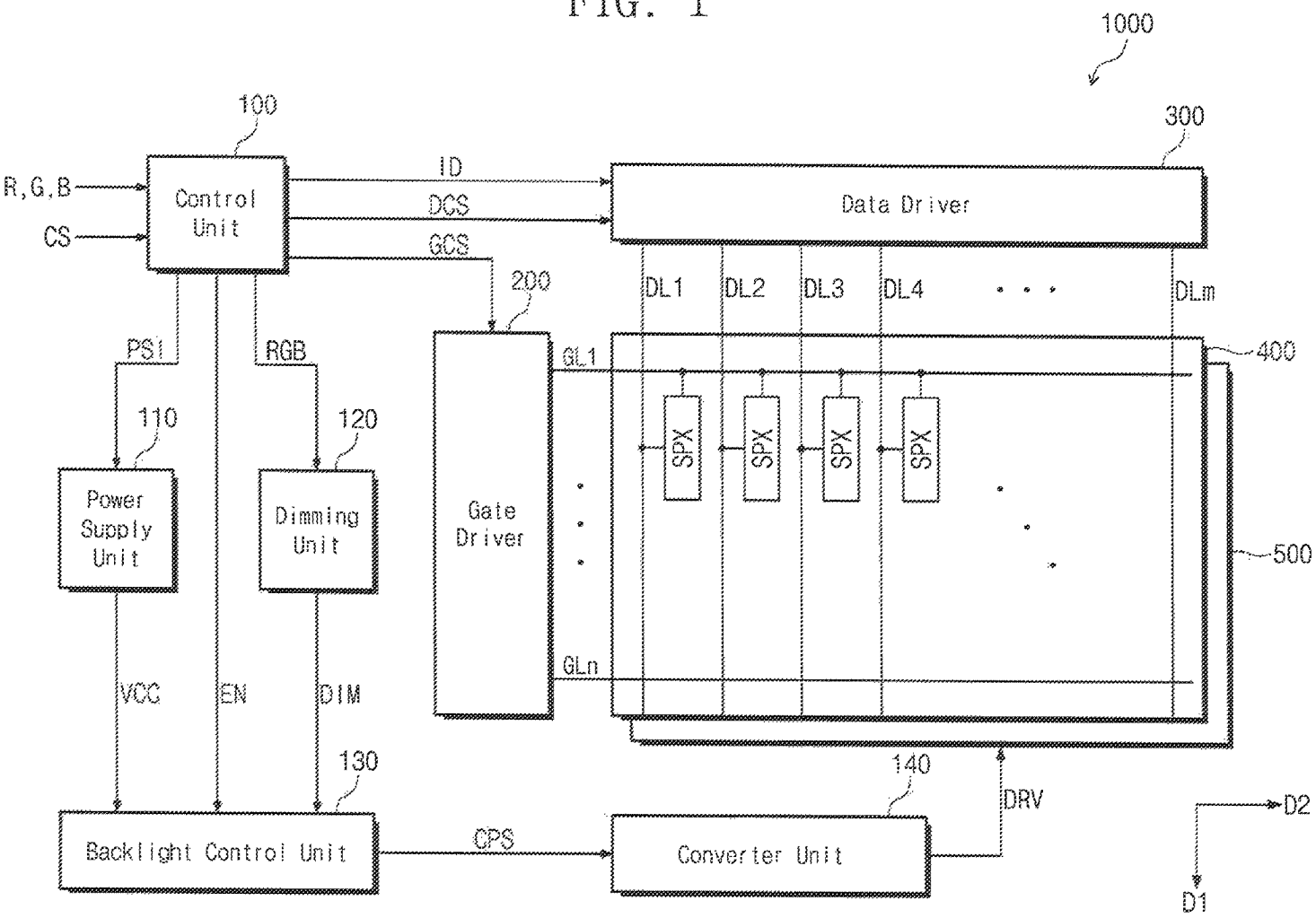
FIG. 1 is a schematic block diagram illustrating a display device according to an exemplary embodiment of the inventive concept.

Exemplary embodiments of the present inventive concept will be described more fully hereinafter with reference to the accompanying drawings. The present invention may, however, be embodied in different forms and should not be construed as limited to the embodiments set forth herein.

Like reference numerals refer to like elements throughout the drawings. The terms of a singular form may include plural forms unless the context indicates a different meaning.

Additionally, it will be understood that when a portion such as a layer, a film, an area, and a plate is referred to as being 'on' another portion, it can be directly on the other portion, or an intervening portion can also be present. On the other hand, it will be understood that when a portion such as a layer, a film, an area, and a plate is referred to as being 'below' another portion, it can be directly below the other portion, or an intervening portion can also be present.

Hereinafter, exemplary embodiments of the inventive concept are described in more detail with reference to the accompanying drawings.

FIG. 1 is a schematic block diagram illustrating a display device according to an embodiment of the inventive concept.

Referring to FIG. 1, a display device 1000 according to an exemplary embodiment of the inventive concept includes a display panel 400 for displaying an image, a gate driver 200 (e.g., a gate driving controller or circuit) and a data driver 300 (e.g., a data driving controller or circuit) for driving the display panel 400, a control unit 100 (e.g., a controller or control circuit) for driving the gate driver 200 and the data driver 300, a backlight unit 500 (e.g., a backlight device or circuit) for providing light to the display panel 400, a converter unit 140 (e.g., a voltage converter or voltage generator) for supplying a driving voltage DRV for driving the backlight unit 500, a backlight control unit 130 (e.g., a controller or control circuit) for generating a control pulse signal CPS for controlling the converter unit 140, and a power supply unit 110 (e.g., a power supply or power supply circuit) for supplying a power voltage VCC to the backlight control unit 130, and a dimming unit 120 for supplying a dimming signal DIM to the backlight control unit 130.

The control unit 100 receives primary color data R, G, and B and a plurality of control signals CS from a source located outside the display device 1000. The control unit 100 converts the data format of the primary color data R, G, and B to correspond to the interface specifications of the data driver 300 in order to generate image data ID and provides the image data ID to the data driver 300.

Additionally, the control unit 100 generates a data control signal DCS (for example, at least one of an output start signal or a parallel start signal) and a gate control signal GCS (for example, at least one of a vertical start signal, a vertical clock signal, and a vertical clock bar signal) on the basis of the plurality of controls signals CS. The data control signal DCS is provided to the data driver 300 and the gate control signal GCS is provided to the gate driver 200.

The gate driver 200 outputs the gate signals sequentially in response to the gate control signal GCS provided from the control unit 100.

The data driver 300 converts the image data ID into data voltages and outputs the data voltages in response to the data control signal DCS provided from the control unit 100. The outputted data voltages are applied to the display panel 400.

The display panel 400 includes a plurality of gate lines GL1 to GLn, a plurality of data lines DL1 to DLm, and a plurality of sub pixels SPX. The sub pixels SPX may display a primary color. For example, the sub pixels SPX may display one of a red color, a green color, and a blue color.

The sub pixels SPX may be elements for displaying a unit image that is used to form an image. The resolution of the display panel 400 may be determined according to the sub pixels SPX. Only four sub pixels are shown in FIG. 1 and the remaining sub pixels are omitted for ease of illustration.

The plurality of gate lines GL1 to GLn may be arranged parallel to each other in a first direction D1 and extend in a second direction D2 vertical to the first direction D1. The plurality of gate lines GL1 to GLn are connected to the gate driver 200 and receive the gate signals from the gate driver 200.

The plurality of data lines DL1 to DLm may extend in the first direction D1 and be arranged parallel to each other in the second direction DR2. The plurality of data lines DL1 to DLm are connected to the data driver 300 to receive the data voltages from the data driver 300.

Each of the sub pixels SPX may be connected to a corresponding gate line among the plurality of gate lines GL1 to GLn and a corresponding data line among the plurality of data lines DL1 to DLm, so that the corresponding sub pixel can be driven.

The backlight unit 500 may be disposed at the rear of the display panel 400 and face the display panel 400. The backlight unit 500 receives a driving voltage DRV generated by the converter unit 140. The backlight unit 500 may include light emitting diode (LED) light sources that generate light in response to the driving voltage DRV and supply the light to the display panel 400. The light sources may include a plurality of light source strings, where each light source string includes a plurality of light sources connected in series to one another. The light source strings may be connected in a parallel to one another.

The backlight unit 500 is driven by the driving voltage DRV. In an embodiment, the power control unit 110 receives a power signal PSI from the control unit 100. The power supply unit 110 generates a power voltage VCC and outputs the power voltage VCC to the backlight control unit 130 in response to the power signal PSI.

The dimming unit 120 receives primary color data R, G, and B directly from the control unit 100 or an outside source. The dimming unit 120 generates a dimming signal DIM and outputs the dimming signal DIM to the backlight control unit 130 in response to the primary color data R, G, and B.

The backlight control unit 130 receives an enable signal EN from the control unit 100. The backlight control unit 130 is turned on or turned off in response to the enable signal. For example, the enable signal may be set to one of a first logic state or level and a second other logic state or level to indicate whether the backlight control unit 130 is to be turned on or off.

The backlight control unit 130 is driven by the power voltage VCC.

The backlight control unit 130 generates a control pulse signal CPS in synchronization with the dimming signal DIM and outputs the control pulse signal CPS to the converter unit 140.

The converter unit 140 generates a driving voltage DRV and outputs the driving voltage DRV to the backlight unit 500 in response to the control pulse signal CPS.

Figure 2:
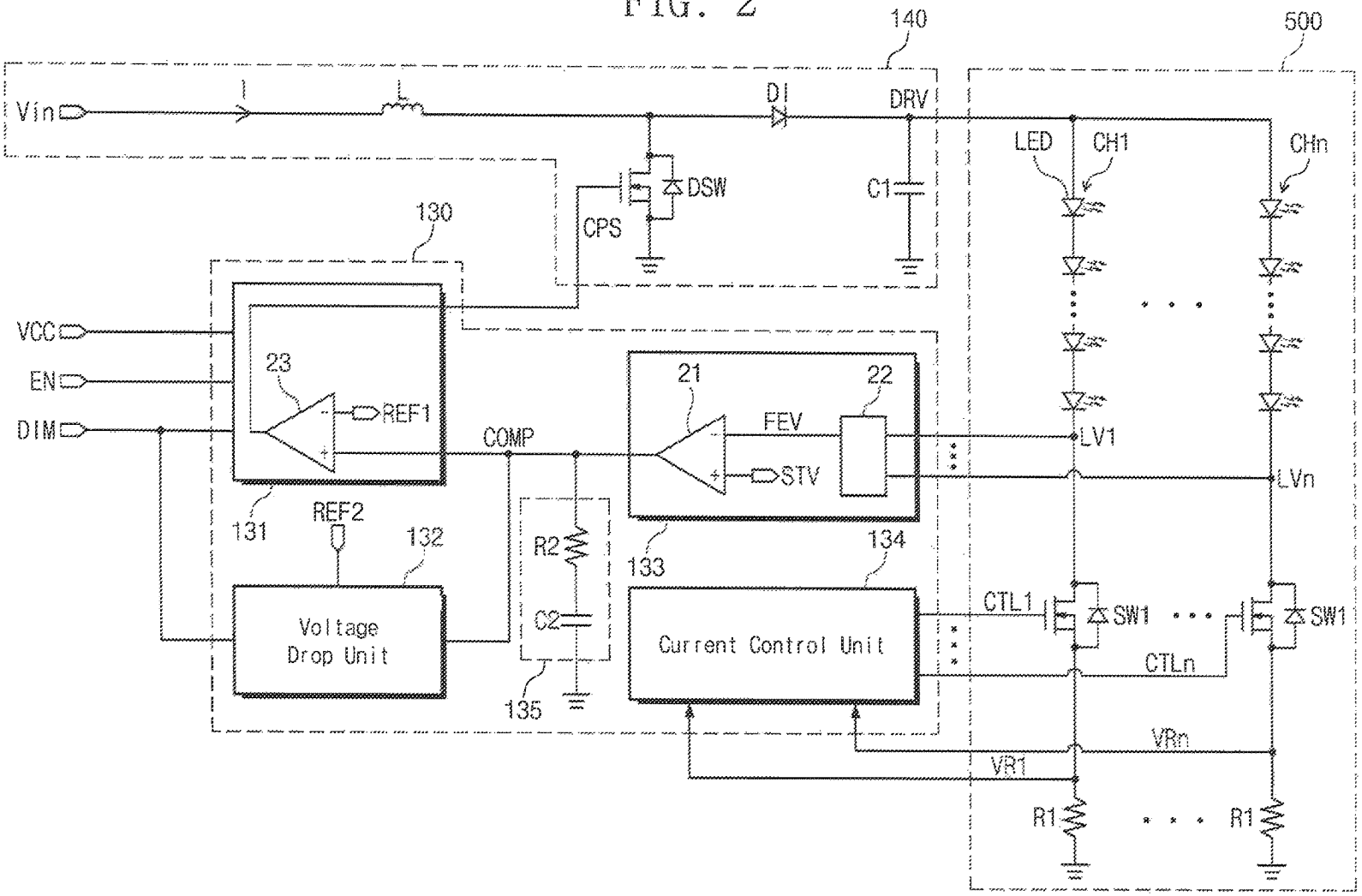
FIG. 2 is a detailed view illustrating a backlight unit, a backlight control unit, and a converter unit according to an exemplary embodiment of the inventive concept.
Figure 3:
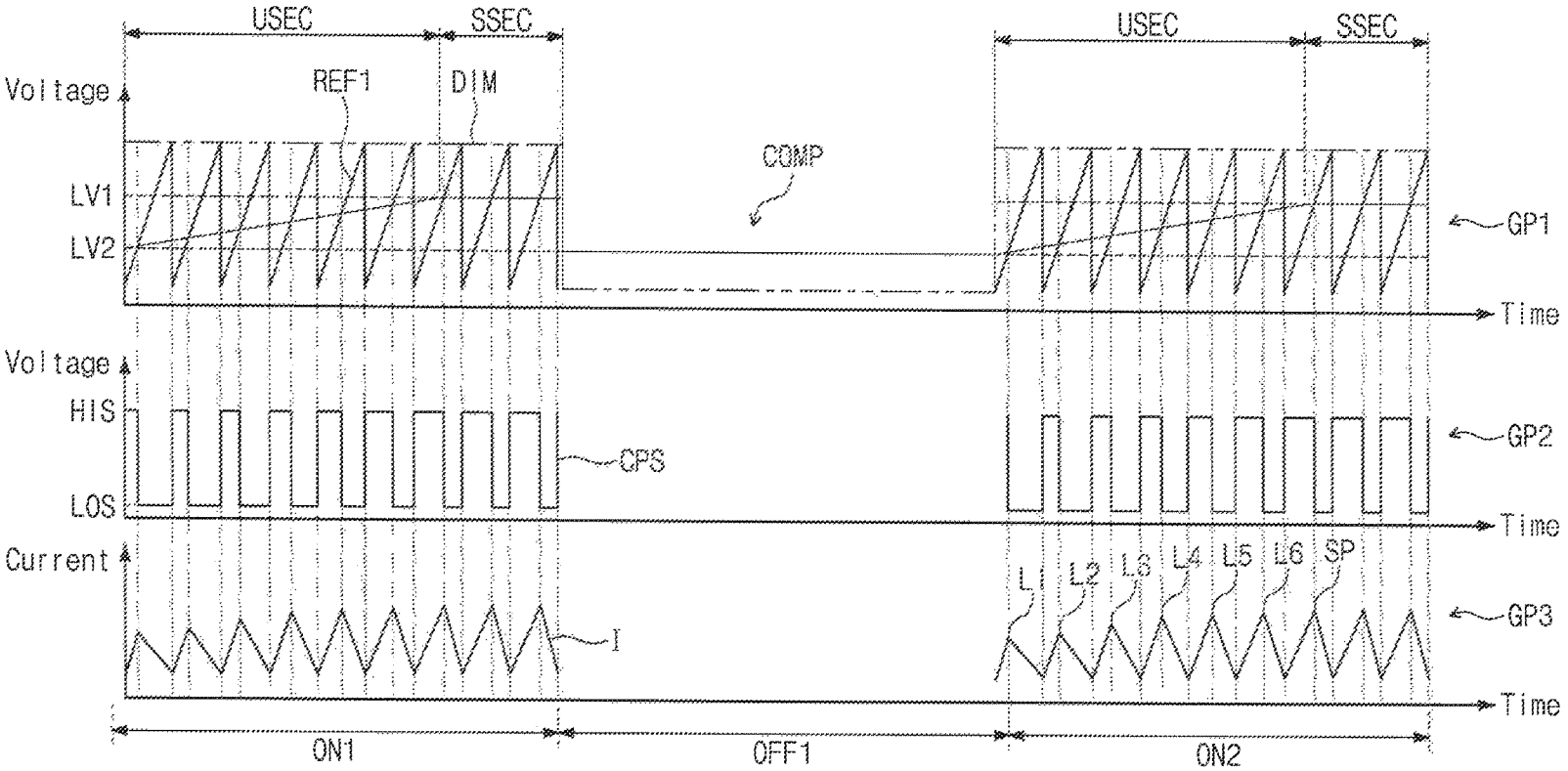
FIG. 3 is a graph illustrating an effect by a voltage drop unit described with reference to FIG. 2.

FIG. 2 is a detailed view of a backlight unit, a backlight control unit, and a converter unit according to an exemplary embodiment of the inventive concept and FIG. 3 is a graph illustrating an effect by a voltage drop unit described with reference to FIG. 2.

A first graph GP1, a second graph GP2, and a third graph GP3 are shown in FIG. 3. In each of the first graph GP1 and the second graph GP2, an X axis represents time and a Y axis represents voltage. In the third graph GP3, an X axis represents time and a Y axis represents voltage.

Hereinafter, the first graph to the third graph GP1 to GP3 are described with reference to FIG. 2.

Referring to FIG. 2, a backlight unit 500 includes a light source array including light sources LED, a first switching element, and a first resistor.

The light sources LED, for example, may include light emitting diodes.

The light source array may be provided in plurality. For example, as shown in FIG. 2, light source arrays CH1 to CHn may include n light source arrays where n is a natural number of one or more.

Each of the light source arrays CH1 to CHn may include one light source LED or two or more light sources LED connected in series. The light sources LED may generate white light that is emitted to the display panel 400. However, the inventive concept is not limited thereto and may be implemented to provide light with a variety of colors.

Each of the light source arrays CH1 to CHn may be driven using the driving voltage DRV that is received at each one end of the light source arrays CH1 to CHn.

The first switching element may be provided in plurality. Each one end of the first switching elements SW1 is connected to each other end of the light source arrays CH1 to CHn. For example, a first end of a series of LEDs is connected to a node receiving the driving voltage DRV, and a second end of the series of LEDs is connected to an end of the switching element SW1. In an embodiment, each first switching element includes a transistor and a diode.

The first resistor may be provided in plurality.

For example, the first resistors R1 may be provided to correspond to the respective first switching elements SW1. For example, in an embodiment, each one end of the first resistors R1 is connected to each other end of the first switching elements SW1. In this embodiment, each other end of the first resistors R1 is connected to a ground electrode.

The first switching elements SW1 and the first resistors R1 will be described below in more detail with a current control unit 134 described later.

The converter unit 140 may include various types of converters. Although it is shown in FIG. 2 that the converter unit 140 includes a boost converter, the inventive concept is not limited thereto. Hereinafter, the converter unit 140 will be described below on the assumption that it includes the boost converter.

The converter unit 140 of FIG. 2 includes an inductor L, a driving switching element DSW, a diode DI, and a first capacitor C1.

The converter unit 140 receives an input voltage Vin. An inductor current I flows through the inductor L and the converter unit 140 generates the driving voltage DRV based on the input voltage Vin.

The converter unit 140 converts the input voltage Vin to the driving voltage DRV through the resonance of the inductor L and the driving switching element DSW controlled in response to the control pulse signal CPS provided from the backlight control unit 130. The converted driving voltage DRV is supplied to each one end of the light source arrays CH1 to CHn. The diode DI may prevent a current supplied to the light source arrays CH1 to CHn from flowing backward. The first capacitor C1 may stabilize the driving voltage DRV.

The backlight control unit 130 includes a light source driving unit 131 (e.g., a light source driving circuit), a voltage drop unit 132 (e.g., a voltage drop circuit), a current control unit 134 (e.g., a current control circuit), a response speed control unit 135 (e.g., a controller or control circuit), and a compensation voltage generation unit 133 (e.g., a compensation circuit).

The current control unit 134 may adjust a current flowing through each of the light source arrays CH1 to CHn.

In an embodiment, the current control unit 134 is connected to the gate electrode of each of the first switching elements SW1 to separately control each of the first switching elements SW1. The first resistors R1 may be provided to sense a current flowing through each of the light source arrays CH1 to CHn. As mentioned above, one end of the first resistors R1 is connected to the other end of the first switching elements SW1 and the other end of the first resistors R1 is connected to the ground electrode.

For example, the current control unit 134 receives voltages applied to the other ends of the first resistors R1 and based on the received voltages, controls each of the first switching elements SW1 separately, so that it controls a current flowing through each of the light source arrays CH1 to CHn.

The compensation voltage generation unit 133 includes a voltage sensing unit 22 (e.g., a voltage sensor) and an error amplifier 21. The voltage sensing unit 22 senses a voltage at each other end of the light source arrays CH1 to CHn. Then, the voltage sensing unit 22 compares the sensed voltages to determine the largest voltage among the sensed voltages, and outputs the largest voltage as a feedback voltage FEV.

The error amplifier 21 outputs a first voltage through an output terminal of the error amplifier 21 by comparing the feedback voltage FEV with a fixed voltage STV. The feedback voltage FEV may be inputted to an inversion input terminal of the error amplifier 21 and the fixed voltage STV may be inputted to a non-inversion input terminal of the error amplifier 21.

Hereinafter, for convenience of description, a voltage at the output terminal of the error amplifier 21 is referred to as a compensation voltage COMP.

The light source driving unit 131 receives the dimming signal DIM.

Referring to FIG. 3, in the first graph GP1, the dimming signal DIM is divided into a signal having an on section and a signal having an off section. The dimming signal DIM has a turn on level in the on section and a turn off level in the off section. In an embodiment, the turn on level is higher than the turn off level.

The on section and the off section may be repeated over time. For example, after a first on section (e.g., ON1) ends, a first off section (e.g., OFF1) starts. After the first off section ends, a second on section (e.g., ON2) starts. After the second on section ends, a second off section starts.

Accordingly, the dimming signal DIM may be a signal where a turn on level and a turn off level are alternately repeated.

In an embodiment, the light source driving unit 131 generates the control pulse signal CPS in synchronization with the dimming signal DIM.

In an exemplary embodiment, the light source driving unit 131 generates the control pulse signal CPS when the dimming signal DIM has the turn on level.

In an embodiment, the light source driving unit 131 includes a pulse output unit 23 for generating the control pulse signal CPS. The pulse output unit 23 may be pulse generator as an example.

In an embodiment, the compensation voltage COMP is the first voltage during the on section (e.g., ON1).

In an embodiment, the pulse output unit 23 outputs the control pulse signal CPS during the on section by comparing the first voltage and a first reference voltage REF1. In an embodiment, the first voltage is applied to a control input terminal of the pulse output unit 23 (e.g., a non-inversion terminal) and the first reference voltage REF1 is applied to a reference input terminal of the pulse output unit 23 (e.g., an inversion terminal). According to an embodiment of the inventive concept, the first reference voltage REF1 is a sawtooth wave. For example, the first reference voltage REF1 may repeatedly include an upwards ramp and a sharp drop. However, the first reference voltage REF1 is not limited thereto in alternate embodiments.

Referring to FIGS. 2 and 3, as shown in the second graph GP2, when the first voltage is greater than the first reference voltage REF1, the pulse output unit 23 outputs a high signal HIS as the control pulse signal CPS and when the first voltage is less than the first reference voltage REF1, the pulse output unit 23 outputs a low signal LOS as the control pulse signal CPS. The high signal HIS and the low signal LOS are signals having a predetermined voltage and a level of the high signal HIS is greater than a level of the low signal LOS.

In an embodiment, the control pulse signal CPS is a pulse width modulation signal having a predetermined duty value. The pulse output unit 23 controls a level of the driving voltage DRV by varying the pulse width of the control pulse signal CPS.

In an embodiment, the response speed control unit 135 is connected to a non-inversion terminal of the pulse output unit 23.

The response speed control unit 135 includes a second resistor R2 and a second capacitor C2.

The response speed control unit 135 controls a response speed of the error amplifier 21 by a time constant determined by the second resistor R2 and the second capacitor C2 to adjust a slew rate of an output signal from the error amplifier 21.

The voltage drop unit 132 receives the dimming signal DIM. In an embodiment, the output terminal of the voltage drop unit 132 is connected to the non-inversion terminal of the pulse output unit 23. According to an exemplary embodiment of the inventive concept, the voltage drop unit 132 outputs a second voltage through the output terminal of the voltage drop unit 132 in synchronization with the dimming signal DIM only during the off section. In an embodiment, the compensation voltage COMP is the first voltage during the on section and the compensation voltage COMP is the second voltage during the off section. In an embodiment, the second voltage is lower than the first voltage. An effect occurring when the compensation voltage COMP is the first voltage during the on section and the compensation voltage COMP is the second voltage during the off section will be described below.

Referring to FIG. 3, the X axis of each of the first graph to third graph GP1 to GP3 includes a first on section ON1 and a second on section ON2 in the on section and a first off section OFF1 in the off section. A temporal order is the order of the first on section ON1, the first off section OFF1, and the second on section ON2. Each of the first on section ON1 and the second on section ON2 is divided into an increase section USEC and a maintenance section SSEC that follows the increase section USEC.

The first one section ON1 and the second on section ON2 may be the same, and hereinafter, the second on section ON2 is described and its content may be identically applied to the first on section ON1.

In the first off section OFF1, the compensation voltage COMP is maintained at the second voltage. In an embodiment, the second voltage in the first off section OFF1 has a second level LV2 that is less than the first level LV1.

Then, when a state of the system changes from the first off section OFF1 to the second on section ON2, as mentioned above, the response speed control unit 135 adjusts a slew rate of an output signal from the error amplifier 21 by controlling a response speed of the error amplifier 21. As a result, the response speed control unit 135 controls the compensation voltage COMP. Accordingly, the first voltage does not have a predetermined level during the second on section ON2.

In an embodiment, a level of the first voltage increases gradually with a predetermined slope in the increase section USEC, and a level of the first voltage is maintained at the first level LV1 in the maintenance section SSEC. For example, the first voltage may gradually increase from the second level LV2 to the first level LV1 in the increase section USEC.

In this embodiment, a pulse width of the control pulse signal CPS increases constantly over time in the increase section USEC and is maintained constantly in the maintenance section SSEC. For example, the pulse width of the pulses of the control pulse signal CPS increase gradually from a first width to a second width during the increase section USEC, and then maintains the second width during the maintenance section SSEC.

As a result, the voltage drop unit 132 outputs the second voltage smaller than the first voltage during the off section, and as the compensation voltage becomes the second voltage, the inductor current I does not have a stable peak value SP in the increase section USEC and has increasing peak values L1 to L6 lower than the stable peak value SP. That is, a peak value of the inductor current I increases slowly over time in the increase section USEC and is maintained constantly at last with the stable peak value SP in the maintenance section SSEC, so that this reduces electromagnetic noise occurring from the inductor L. For example, the peak value of the inductor current I increases slowly over time in the increase section USEC, increases to the stable peak value SP in the beginning of the maintenance section SSEC, and then maintains the stable peak value SP during the remainder of the maintenance section SSEC.

Figure 4:
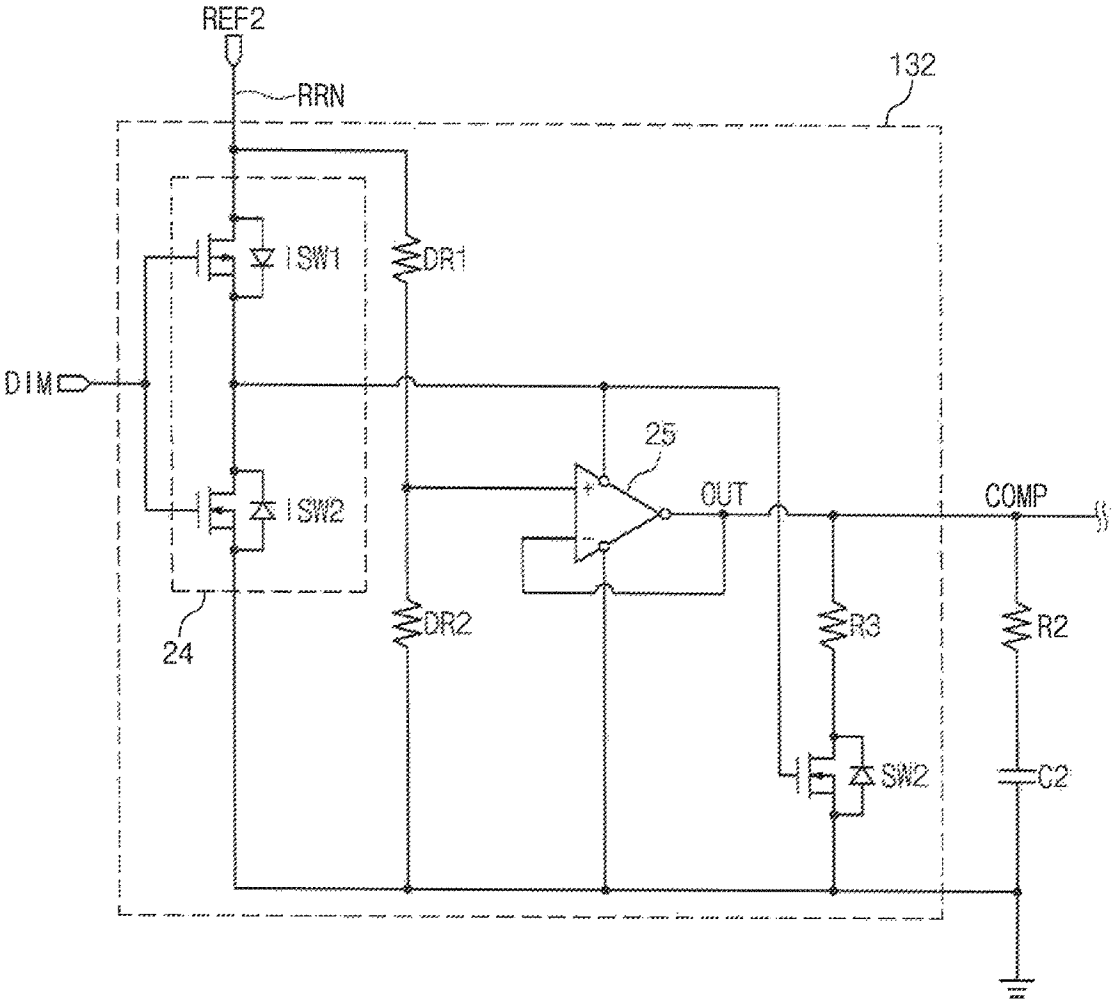
FIG. 4 is a detailed view for describing a voltage drop unit.

FIG. 4 is a detailed view for describing a voltage drop unit according to an exemplary embodiment of the inventive concept.

Referring to FIGS. 2 and 4, the voltage drop unit 132 includes an inverter unit 24 (e.g., an inverter circuit) and a buffer unit 25 (e.g., a buffer or buffer circuit).

The inverter unit 24 outputs an inversed signal of the dimming signal DIM.

The inverter unit 24 includes a first inverse switching element ISW1 and a second inverse switching element ISW2. The first inverse switching element ISW1 and the second inverse switching element ISW2 may each include a transistor and a diode.

The first inverse switching element ISW1 may be a positive P-type metal oxide semiconductor field effect transistor (MOSFET) and the second inverse switching element ISW2 may be a negative N-type MOSFET. However, the inventive concept is not limited thereto and the inverter unit 24 may be implemented in other forms.

The inverter unit 24 may output an inversed signal of the dimming signal DIM through an output terminal of the inverter unit 24.

Accordingly, the inverter unit 24 may output a signal having a turn off level obtained by inversing a signal of a turn on level and output a signal of a turn on level obtained by inversing a signal of a turn off level in the off section.

In an embodiment, the power terminal of the buffer unit 25 receives a signal outputted from the output terminal of the inverter unit 24. The buffer unit 25 may be implemented by an operational amplifier. The power terminal may be the positive power supply of the operational amplifier.

In an embodiment, the buffer unit 25 is turned off when its power terminal receives a signal of a turn off level during the on section and is turned on when its power terminal receives a signal of a turn on level during the off section. Accordingly, the buffer unit 25 only operates during the off section and does not operate during the on section.

Hereinafter, an operation of the voltage drop unit 132 during the off section will be described next.

The voltage drop unit 132 further includes a first distribution resistor DR1 and a second distribution resistor DR2.

One end of the first distribution resistor DR1 is connected to an auxiliary reception terminal RRN of the voltage drop unit 132 and the other end of the first distribution resistor DR1 is connected to one end of the second distribution resistor DR2 and an input terminal of the buffer unit 25.

The other end of the second distribution resistor DR2 is connected to the ground electrode and the output terminal OUT of the buffer unit 25 is connected to the control input terminal of the pulse output unit 23 (e.g., the non-inversion terminal) shown in FIG. 2. The inversion terminal of the buffer unit is connected to the output terminal of the buffer unit 25.

The voltage drop unit 132 may generate the second voltage by distributing the second reference voltage REF2 by using a ratio of a resistance of the first distribution resistor DR1 to a resistance of the second distribution resistor DR2.

For example, when the second reference voltage REF2 is 6 V and the first distribution resistor DR1 and the second distribution resistor DR2 have the same resistance values, the second voltage may be 3 V.

The second voltage is inputted to the input terminal of the buffer unit 25 and the inputted second voltage is outputted through the output terminal of the buffer unit 25.

The second voltage may depend on a ratio of the first distribution resistor DR1 and the second distribution resistor DR2 and a value of the second reference voltage REF2. Accordingly, the second voltage may be set to be smaller than the first voltage.

When the second voltage is set to be smaller than the first voltage, as mentioned above, electromagnetic noise occurring from the inductor current I may be improved.

The voltage drop unit 132 further includes a third resistor R3 and a second switching element SW2. The second switching element SW2 may include a transistor and a diode.

One end of the third resistor R3 is connected to the output terminal of the buffer unit 25; the other end of the third resistor R3 is connected to the input electrode of the second switching element SW2; and the output electrode of the second switching element SW2 is connected to the ground electrode. The gate electrode of the second switching element SW2 is connected to the output terminal of the inverter unit 24.

In the off section, the second switching element SW2 receives the signal of the turn on level to electrically connect the other end of the third resistor R3 to the ground electrode. Accordingly, in the off section, the output terminal of the buffer unit 25 is prevented from becoming a floating state. As a result, in the off section, the compensation voltage COMP is the second voltage.

On the other hand, in the on section, the second switching element SW2 receives the signal of the turn off level so that the other end of the third resistor R3 is not electrically connected to the ground electrode.

In this case, as described with reference to FIG. 2, in the on section, each of the light source arrays CH1 to CHn is driven by the driving voltage DRV and the compensation voltage COMP is the first voltage.

In summary, in the on section, the first voltage, that is, the compensation voltage COMP is applied to the non-inversion terminal of the pulse output unit 23 and in the off section, the compensation voltage COMP is maintained at the second voltage.

According to an embodiment of the inventive concept, as a voltage drop unit of a backlight control unit outputs the second voltage smaller than the first voltage as a compensation voltage during an off section of a dimming signal, an inductor current of a converter unit increases gradually over time. As a result, electromagnetic noise occurring from an inductor may be reduced.

Although exemplary embodiments of the present invention have been described above, it is understood that the present invention is not limited to these exemplary embodiments but various changes and modifications can be made by one of ordinary skilled in the art within the spirit and scope of the present invention.

What is claimed is:

1. A display device comprising:

a plurality of light source strings connected in parallel one another and configured to be driven by a driving voltage, turned on during an on section of a dimming signal, and turned off during an off section of the dimming signal;

a display panel configured to display an image by using light outputted from the light source strings;

a voltage converter connected to the light source strings and configured to generate the driving voltage; and a backlight control circuit including a light source driving circuit, a voltage drop circuit, and a compensation circuit, wherein the light source driving circuit comprises a pulse generator including a control input terminal configured to receive a compensation voltage and output a control pulse signal to control a level of the driving voltage based on the compensation voltage applied to the control input terminal, wherein the compensation circuit senses a voltage at ends of each of the light source strings and outputs a first voltage as the compensation voltage based on the sensed voltage, wherein the voltage drop circuit receives the dimming, signal and connects the control input terminal to a ground electrode to output a second voltage as the compensation voltage during the off section of the dimming signal, wherein the second voltage is smaller than the first voltage.

2. The display device of claim 1, wherein the first voltage is determined based on a voltage at one end of each of the light source strings during the on section of the dimming signal.

3. The display device of claim 1, wherein the light source driving circuit outputs the control pulse signal to the voltage converter and determines a width of the control pulse signal based on a voltage applied to the control input terminal, and wherein the voltage converter generates the driving voltage based on the width of the control pulse signal.

4. The display device of claim 3, wherein the pulse generator further comprises a reference input terminal and an output terminal, wherein the pulse generator outputs a high signal to the output terminal when a voltage inputted to the control input terminal is greater than a first reference voltage applied to the reference input terminal, and wherein the pulse generator outputs a low signal to the output terminal when a voltage inputted to the control input terminal is smaller than the first reference voltage.

5. The display device of claim 4, wherein the backlight control circuit further comprises a response control circuit configured to control a level of the first voltage over time in the on section, and wherein the level of the first voltage increases over time in an increase section of the on section and is maintained at a constant level over time in a maintenance section of the on section.

6. The display device of claim 5, wherein the response control circuit is connected to the control input terminal and the response control circuit comprises a control resistor and a control capacitor.

7. The display device of claim 6, wherein a pulse width of he control pulse signal increases over time in the increase section.

8. The display device of claim 1, further comprising a dimming circuit configured to output the dimming signal to control a brightness of the light source strings, and the dimming signal has a turn on level in the on section and has a turn off level in the off section.

9. The display device of claim 8, wherein the voltage drop circuit comprises an auxiliary reception terminal, a first distribution resistor, and a second distribution resistor.

10. The display device of claim 9, wherein the voltage drop circuit further comprises a buffer circuit configured to output the second voltage, wherein one end of the first distribution resistor is connected to the auxiliary reception terminal and the other end of the first distribution resistor is connected to one end of the second distribution resistor and an input terminal of the buffer circuit, wherein the other end of the second distribution resistor is connected to a ground electrode, and wherein an output terminal of the buffer circuit is connected to the control input terminal.

11. The display device of claim 10, wherein the voltage drop circuit further comprises an inverter, wherein one end of the inverter is connected to the dimming circuit and the other end of the inverter is connected to a power terminal of the buffer circuit, and wherein the buffer circuit is turned off by the turn on level and is turned on by the turn off level.

12. The display device of claim 11, wherein the voltage drop circuit further comprises a third resistor and a switching element, wherein one end of the third resistor is connected to an output terminal of the buffer circuit and the other end of the third resistor is connected to an input electrode of the switching element, and wherein an output electrode of the switching element is connected to the ground electrode and a gate electrode of the switching element is connected to the other end of the inverter.

13. The display device of claim 1, wherein the compensation circuit comprises:

a voltage sensor for sensing the voltage at the ends of each of the light source strings to determine the largest voltage, and outputting the largest voltage as a feedback voltage; and an amplifier receiving the feedback voltage and outputting the first voltage as a compensation voltage to the pulse generator.

14. A display device driving method comprising:

outputting, by a dimming circuit, a dimming signal having a turn on level indicating that a plurality of light source strings is to be turned on during an on section and having a turn off level indicating that the light source strings are to be turned off during an off section;

sensing, by a compensation circuit, a voltage at ends of each of the light source strings to determine a large voltage among the sensed voltages;

applying, by the compensation circuit, a first voltage as a compensation voltage based on the largest voltage to a control input terminal of a pulse generator during the on section in response to the dimming signal having the turn on level;

applying, by a voltage drop circuit, a second voltage as the compensation voltage to the control input terminal during the off section in response to the dimming signal having the turn off level;

outputting, by the pulse generator, a control pulse signal based on the compensation voltage; and controlling, by a voltage converter, a level of a driving voltage applied to the light source strings based on the control pulse signal, wherein the second voltage is smaller than the first voltage, wherein the light source strings are connected in parallel to one another.

15. The method of claim 14, wherein the pulse generator outputs the control pulse signal by comparing the compensation voltage and a first reference voltage during the on section.

16. The method of claim 15, wherein the control pulse signal has a high level during the on section when the compensation voltage is greater than the first reference voltage and the control pulse signal has a low level during the on section when the compensation voltage is smaller than the first reference voltage.

17. The method of claim 16, wherein a level of the compensation voltage increases over time during an increase section of the on section and is maintained at constant level during a maintenance section of the on section, and the maintenance section is located between the increase section and the off section.

18. The method of claim 14, wherein the voltage drop circuit generates the second voltage by:

receiving a second reference voltage from an auxiliary reception terminal during the off section; and distributing the second reference voltage using a ratio of a resistance of a first distribution resistor to a resistance of a second distribution resistor.

19. The method of claim 18 wherein the generating of the second voltage further comprises applying a voltage distributed by the ratio to a buffer input terminal of a buffer circuit, wherein one end of the first distribution resistor is connected to the auxiliary reception terminal and the other end of the first distribution resistor is connected to one end of the second distribution resistor and the buffer input terminal, and wherein the other end of the second distribution resistor is connected to a ground electrode and a buffer output terminal of the buffer circuit is connected to the control input terminal.

20. A backlight circuit comprising:

a plurality of light source strings;

a dimming circuit configured to output a dimming signal having a turn on level indicating that the light source strings are to be turned on during an on section and having a turn off level indicating that the light source strings are to be turned off during an off section;

a pulse generatorincluding a control input terminal to output a control pulse signal;

a compensation circuit configured to apply a first voltage to a control input terminal of the pulse generator during the on section in response to the dimming signal having the turn on level;

a voltage drop circuit configured to apply a second voltage to the control input terminal during the off section in response to the dimming signal having the turn off level; and a voltage converter configured to control a level of a driving voltage applied to each of the light source strings based on the control pulse signal output by the pulse generator, wherein the second voltage is smaller than the first voltage, wherein a level of the first voltage increases over the time during an increase section of the on section and is maintained at a constant level during a maintenance section of the on section.

21. . The backlight circuit of claim 20, wherein the pulse generator outputs the control pulse signal by comparing the first voltage and a first reference voltage during the on section.

22. The backlight circuit of claim 21, the control pulse signal has a high level during the on section when the first voltage is greater than the first reference voltage and the control pulse signal has a low voltage when the first voltage is smaller than the first reference voltage.

23. The backlight circuit of claim 22, wherein the maintenance section is located between the increase section and the off section.

* * * * *